US006683408B2

(12) United States Patent
Ichikawa

(10) Patent No.: US 6,683,408 B2
(45) Date of Patent: Jan. 27, 2004

(54) ELECTRON-EMITTING DEVICE, ELECTRON SOURCE AND IMAGE-FORMING APPARATUS

(75) Inventor: Takeshi Ichikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 09/949,722

(22) Filed: Sep. 12, 2001

(65) Prior Publication Data

US 2002/0030436 A1 Mar. 14, 2002

(30) Foreign Application Priority Data

Sep. 14, 2000 (JP) ..... 2000-280353
Sep. 6, 2001 (JP) ..... 2001-270703

(51) Int. Cl.[7] ..... H01J 1/62; H01J 63/04
(52) U.S. Cl. ..... 313/495; 313/309
(58) Field of Search ..... 313/495, 309, 313/336; 257/10, 11

(56) References Cited

U.S. PATENT DOCUMENTS

| | | | | |
|---|---|---|---|---|
| 5,629,579 A | * | 5/1997 | Zimmerman | 313/309 |
| 5,696,028 A | * | 12/1997 | Rolfson et al. | 438/20 |
| 5,713,774 A | * | 2/1998 | Thomas et al. | 445/23 |
| 5,720,641 A | * | 2/1998 | Hattori | 445/50 |
| 5,831,378 A | * | 11/1998 | Rolfson et al. | 313/336 |
| 5,872,422 A | * | 2/1999 | Xu et al. | 313/311 |
| 5,939,823 A | | 8/1999 | Kiyomiya et al. | 313/495 |
| 5,989,404 A | | 11/1999 | Kiyomiya et al. | 205/96 |
| 6,004,830 A | * | 12/1999 | Potter | 438/20 |
| 6,135,839 A | | 10/2000 | Iwase et al. | 445/24 |

FOREIGN PATENT DOCUMENTS

| | | |
|---|---|---|
| JP | 8-96703 | 4/1996 |
| JP | 8-96704 | 4/1996 |
| JP | 8-264109 | 10/1996 |
| JP | 10-289650 | 10/1998 |

OTHER PUBLICATIONS

W.P. Dyke et al., *Field Emission*, Advances in Electronics and Electron Physics, vol. III (1956) pp. 90–185.
G. Ditmer, *Electrical Conduction and Electron Emission of Discontinuous Thin Films*, Thin Solid Films—Elsevier Sequoia S.A., vol. 9 (1972), pp. 317–328.
Hisashi Araki et al., *Electroforming and Electron Emission of Carbon Thin Films*, (1981) pp. 22–29 (English Abstract on p. 22).
C.A. Mead, *Operation of Tunnel–Emission Devices*, Journal of Applied Physics, vol. 32, No. 4, (1961) pp. 646–652.
C.A. Spindt et al., *Physical Properties of Thin–film Field Emission Cathodes with Molybdenum Cones*, J. Appl. Phys, vol. 47, No. 12, (1976), pp. 5249–5263.

(List continued on next page.)

*Primary Examiner*—Sandra O'Shea
*Assistant Examiner*—Dalei Dong
(74) *Attorney, Agent, or Firm*—Fitzpatrick, Cella, Harper & Scinto

(57) ABSTRACT

A field emission electron-emitting device in which an electron beam diameter is small and an electron emission area is large, with which highly efficient electron emission is possible at a low voltage, and which can be easily manufactured. Also provided is an electron source and an image-forming apparatus that use the electron-emitting device. An opening is formed to penetrate through a first electrode layer and a first insulating layer, and a second insulating layer is included in the opening. The second insulating layer is provided with an opening having a taper such that an opening area gradually decreases from the first electrode layer side to the second electrode layer side. A third electrode layer is provided between the second insulating layer and the second electrode layer. The third electrode layer is also provided with an opening, in which an electron-emitting layer comprised of an electron-emitting material is formed.

16 Claims, 15 Drawing Sheets

OTHER PUBLICATIONS

M.L. Elinson et al., *The Emission of Hot Electrons and the Field Emission of Electrons from Tin Oxide*, Radio Engineering and Electronic Physics, (1965) pp. 1290–1296.

M. Hartwell et al., *Strong Electron Emission from patterned Tin–Indium Oxide Thin Films*, International Electron Devices Meeting Technical Digest (1975) pp. 519–521.

Kusunoki et al., *Fluctuation–Free Electron Emission from Non–Formed Metal–Insulator–Metal (MIM) Cathodes Fabricated by Low Current Anodic Oxidation*, Jpn. J. Appl. Phys., vol. 32 pp. L1695–1697, Part 2, No. 11B (1993).

Suzuki et al., *An MIM–cathode Array for Cathodoluminescent Displays*, IDW96 (1996) pp. 529–530.

* cited by examiner

ELECTRON-EMITTING DEVICE, ELECTRON SOURCE AND IMAGE-FORMING APPARATUS

BACKGROUND OF THE INVENTION

1. Field of the Invention

The present invention relates to an electron-emitting device for emitting electrons by the application of a voltage, an electron source and an image-forming apparatus employing the electron-emitting device.

2. Related Background Art

Conventionally, two types of electron sources, a thermionic cathode electron source and a cold cathode electron source are known as an electron-emitting device. The cold cathode electron source includes a field emission (hereinafter referred to as FE) electron-emitting device, a metal/insulator layer/metal (hereinafter referred to as MIM) electron-emitting device, a surface conduction electron-emitting device and the like.

As examples of the FE electron-emitting device, those disclosed in W. P. Dyke & W. W. Dolan, "Field Emission", Advance in Electron Physics, 8, 89 (1956), C. A. Spindt, "Physical Properties of thin-film field emission cathodes with molybdenium cones", J. Appl. Phys., 47,5248 (1976) and the like are known.

As examples of the MIM electron-emitting device, those disclosed in C. A. Mead, "Operation of Tunnel-Emission Devices", J. Apply. Phys., 32,646 (1961) and the like are known.

In addition, in recent examples, Toshiaki Kusunoki, "Fluctuation-free electron emission from non-formed metal-insulator-metal (MIM) cathodes fabricated by low current anodic oxidation", Jpn. J. Appl. Phys. Vol. 32 (1993) pp. L1695, Mutsumi Suzuki et al., "An MIM-Cathode array for Cathode Luminescent Displays", IDW '96, (1996) pp. 529 and the like are studies.

As examples of the surface conduction electron-emitting device, there are those described in an Elinson report (M. I. Elinson, Radio Eng. Electron Phys., 10 (1965)) or the like. This surface conduction electron-emitting device utilizes a phenomenon that electron emission is caused by flowing a current to a thin film with a small area, which is formed on a substrate, in parallel with the surface of the film.

As the surface conduction electron-emitting device, one using an $SnO_2$ thin film described in the above-mentioned Elinson report, one using an Au thin film (G. Dittmer, Thin Solid Films, 9,317 (1972)), one using an $In_2O_3/SnO_2$ thin film (M. Hartwell and C. G. Fonstad, IEEE Trans. ED Conf., 519 (1983)) and the like are reported.

SUMMARY OF THE INVENTION

However, in the case of the above-mentioned conventional art, there are problems as described below.

In order to apply an electron-emitting device to an image-forming apparatus, an emission current for causing a phosphor to emit light with sufficient luminance is required. In addition, a diameter of an electron beam irradiated on a phosphor is required to be small for making a display high in definition. Moreover, it is important that the electron-emitting device can be manufactured easily.

As an example of the conventional FE electron-emitting device, a Spindt type electron emitting-device is shown in FIG. 13. In FIG. 13, reference numeral 1 denotes a substrate, 4 denotes a cathode electrode layer (low potential electrode), 3 denotes an insulating layer, 2 denotes a gate electrode layer (high potential electrode), 5 denotes a microchip and 6 denotes an equipotential surface.

When a bias is applied between the microchip 5 having a curvature r and the gate electrode layer 2, electrons are emitted from the tip of the microchip 5 and heads for an anode. An amount of the emitted electrons is determined by a work function of a distance d between the gate electrode layer 2 and the tip of the microchip 5, a gate voltage Vg and a material of an emitting portion. That is, it is an element for determining performance of a device to manufacture it with good control of the distance d between the gate electrode layer 2 and the microchip 5.

A general manufacturing process of the Spindt type electron-emitting device is shown in FIG. 14.

The manufacturing process will be described along this figure. First, the cathode electrode layer 4 made of Nb or the like, the insulating layer 3 made of $SiO_2$ or the like and the gate electrode layer 2 made of Nb or the like are stacked in this order on the substrate 1 made of glass. Thereafter, a circular opening (fine hole) perforating through the gate electrode layer 2 and the insulating layer 3 is formed by a reactive ion etching method (FIG. 14A).

Then, a sacrifice layer 7 made of aluminum or the like is formed on the gate electrode layer 2 by diagonal evaporation or the like (FIG. 14B).

A microchip material 8 such as molybdenum is deposited by a vacuum evaporation method on the structure formed as described above. Thus, the deposit on the sacrifice layer 7 stuffs the inside of the opening as deposition advances, and the microchips 5 are formed in a conical shape inside the opening (FIG. 14C).

Lastly, the sacrifice layer 7 is dissolved, whereby the microchip material 8 is lifted off to complete a device (FIG. 14D).

However, it is difficult for such a manufacturing method to manufacture the device with good control of the above-mentioned distance d, and an amount of emission current varies for each device. In addition, it is likely that a metal piece or the like generated during the lift-off causes short-circuit of the microchip 5 and the gate electrode layer 2. In this case, if a voltage is applied between the microchip 5 and the gate electrode layer 2 at the time of driving, heat is generated in a shorted part to cause destruction of the shorted part and the part around it. Thus, an effective emission area is reduced.

If the electron-emitting device is applied as, for example, an image-forming apparatus, variation of an amount of emission current for each device causes unevenness of luminance, which makes an image extremely unsightly.

Moreover, in this example, since electrons are emitted from one emitting point, if a density of emission current is increased in order to cause the phosphor to emit light, thermal destruction of the electron-emitting region is induced, which limits a life of the FE device. In addition, ions existing in the vacuum intensively may sputter the tip of the microchip, thereby reducing the life of the device.

Further, electrons emitted into the vacuum usually advances perpendicular to the equipotential surface 6. However, in the configuration as shown in FIG. 13, since the equipotential surface 6 is formed in a hole along the microchip 5, electrons emitted from the tip of the microchip 5 tend to spread.

In addition, when spreading is caused in the emitted electrons in this way, a part of the emitted electrons is absorbed in the gate electrode layer 2, whereby an amount of electrons reaching the anode is reduced. The amount of electrons absorbed in the gate electrode layer 2 tends to increase as the distance d is reduced.

In order to overcome such drawbacks of the FE device, various examples have been proposed as individual solutions.

As an example for preventing spreading of electron beams, there is an example in which focusing electrodes 9 are disposed above the electron-emitting region as shown in FIG. 15. FIG. 15 is a view showing a configuration of an FE device with focusing electrodes. In this example, emitted electron beams are focused by a negative potential of the focusing electrodes 9. A process that is more complicated than the above-mentioned manufacturing process is required in this example, which causes increase in manufacturing costs.

As an example of reducing an electron beam diameter without disposing a focusing electrode, there is a method that does not involve formation of a microchip such as the Spindt type. For example, there are technologies disclosed in Japanese Patent Application Laid-open No. 8-096703, Japanese Patent Application Laid-open NO. 8-096704, Japanese Patent Application Laid-open No. 8-264109, U.S. Pat. No. 5,939,823, U.S. Pat. No. 5,989,404 and the like.

These disclosed technologies have advantages that flat equipotential surfaces are formed on an electron emitting surface and spreading of electron beams becomes smaller because electrons are emitted from a thin film disposed in a hole.

In addition, there are also advantages that, since a material with a low work function is used as an electron emitting substance, electrons can be emitted without forming a microchip, driving is allowed at a low voltage and a manufacturing method is relatively simple.

Moreover, there are also advantages that, since electrons are emitted on a plane, concentration of electric fields does not occur, destruction of chips is not caused and a length of life will be longer.

However, since a distribution of potentials correlated to a depth of the hole and a distance between gate electrode layers is formed around the hole in these examples, emitted electrons still tend to spread, although not so widely as in the Spindt type. Thus, the problem that a part of the emitted electrons is absorbed in the gate electrode layer 2 or scattered has not been solved.

As an example of improving an electron emission efficiency, there is, for example, a technology disclosed in Japanese Patent Application Laid-open No. 10-289650 as shown in FIG. 16.

In this technology, a device has a structure in which the gate electrode layer 2 and a second electrode layer 11 are provided on both sides of the cathode electrode layer 4 via the insulating layers 3, respectively.

Then, a positive potential is applied (provided that $0<|Vg1|\leqq|Vg2|$) to the gate electrode layer 2 and the second gate electrode layer 11 with respect to the cathode electrode layer 4, whereby an amount of electrons emitted from the cathode electrode layer 4 is increased. However, the emitted electrons still tend to spread.

On the other hand, the MIM electron-emitting device has a structure in which the insulating layer 3 is disposed between a lower electrode (cathode electrode layer 4) and an upper electrode (gate electrode layer 2) as shown in FIG. 17 to apply a voltage between both the electrodes and take out electrons.

In the case of this structure, since a direction of an internal electric field and a direction of emitted electrons coincide with each other and there is no distortion in a distribution of potentials on the emission surface, a small electron beam diameter can be realized. However, efficiency is generally low because scattering of electrons occurs in the insulating layer 3 and the upper electrode.

A conventional example in which these electron-emitting devices are applied as an image-forming apparatus will now be described with reference to FIG. 18. FIG. 18 is a view illustrating the case in which an electron-emitting device in accordance with the conventional art is applied to an image-forming apparatus.

As shown in the figure, the image-forming apparatus constitutes a so-called triode device in which lines of the gate electrode layers 2 and lines of the cathode electrode layers 4 are arranged in a matrix shape, and electron-emitting devices 14 are disposed at intersections of both the lines. Electros are emitted from the electron-emitting device 14 of a selected intersection and accelerated by a voltage of an anode 12 to be incident in a phosphor 13 according to an information signal.

If it is considered that a field emission electron-emitting device is applied to the above-mentioned image-forming apparatus such as a display, the device is required to meet the following conditions:

(1) an electron beam diameter is small;

(2) an electron emission area is large;

(3) highly efficient electron emission is possible at a low voltage; and (4) a manufacturing process is easy.

It is difficult to meet these conditions simultaneously using the conventional electron-emitting device.

The present invention has been devised in order to solve the above-mentioned problems of the conventional art, and it is an object of the present invention to provide a field emission electron-emitting device in which an electron beam diameter is small and an electron emission area is large, with which highly efficient electron emission is possible at a low voltage and whose manufacturing process is easy.

In order to attain the above-mentioned object, an electron-emitting device of the present invention includes:

first and second electrode layers;

a first insulating layer sandwiched between the first electrode layer and the second electrode layer;

an opening penetrating through the first electrode layer and the first insulating layer; and an electron emitting material disposed in the opening and connected to the second electrode layer, and is characterized in that a second insulating layer having an opening that is shaped in a taper such that an opening area on the first electrode layer side is larger than an opening area on the second electrode layer side is provided in the opening, and that a third electrode layer having an opening disposed between the second insulating layer and the second electrode layer, and the electron-emitting material is formed inside the opening of the third electrode layer.

In addition, the electron-emitting device of the present invention includes:

first and second electrode layers;

a insulating layer formed between the first electrode layer and the second electrode layer;

a first opening disposed in the first electrode layer;

a second opening disposed in the insulating layer and communicating with the first opening; and an electron-emitting film disposed in the second opening and connected to the second electrode layer, and is characterized in that the second opening is shaped in a taper such that an opening area on the first electrode layer side is larger than an opening area on the second electrode layer side, and an outer circumference of the electron-emitting film is sandwiched between the insulating layer and the second electrode layer.

In addition, the electron-emitting device of the present invention is characterized in that the electron-emitting material is a conductor.

In addition, the electron-emitting device of the present invention is characterized in that the second electrode layer, the third electrode layer and the electron-emitting material are at the same potential.

In addition, the electron-emitting device of the present invention is characterized in that the exposed surface of the electron-emitting material is positioned on a surface on a same level as the boundary of the second insulating layer and the third electrode layer or on the second electrode layer side.

In addition, the electron-emitting device of the present invention is characterized in that an opening shape of the opening is substantially circular.

In addition, the electron-emitting device of the present invention is characterized in that an opening shape of the opening is line-like.

In addition, the electron-emitting device of the present invention is characterized in that the first insulating layer and the second insulating layer are made of separate materials formed by different processes.

In addition, the electron-emitting device of the present invention is characterized in that a dielectric constant of the second insulating layer part is larger than a dielectric constant of the first insulating layer part.

In addition, the electron-emitting device of the present invention is characterized in that the third electrode layer and the electron-emitting material are formed of an identical material.

In addition, an electron source of the present invention is characterized in that a plurality of the above-mentioned electron-emitting devices are disposed.

In addition, the electron source of the present invention is characterized in that the plurality of electron-emitting devices are matrix-wired.

In addition, an image-forming apparatus of the present invention includes the electron source and an image-forming material for forming an image by electrons emitted from the electron source colliding with it.

In addition, the image-forming apparatus of the present invention is characterized in that the image-forming material is a luminous body for emitting light by the collision of electrons.

BRIEF DESCRIPTION OF THE DRAWINGS

The accompanying drawings, which are incorporated in and constitute a part of the specification, illustrate embodiment modes of the invention and, together with the description, serve to explain the principles of the invention.

DETAILED DESCRIPTION OF THE PREFERRED EMBODIMENTS

Figure 1:
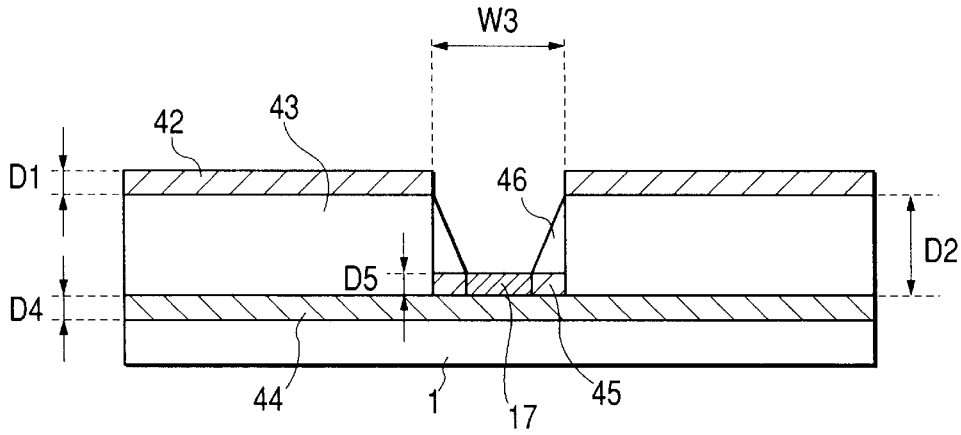
FIG. 1 is a schematic sectional view of an electron-emitting device in accordance with an embodiment mode of the present invention.

Preferred embodiment modes of the present invention will be hereinafter described with reference to the drawings. Further, dimensions, materials and shapes of components and their relative arrangements described in the embodiment modes are not intended to limit the scope of the present invention to them only unless specifically described otherwise.

In addition, in the accompanying drawings, like reference numerals designate the same or similar parts throughout the figures thereof.

Figure 2:
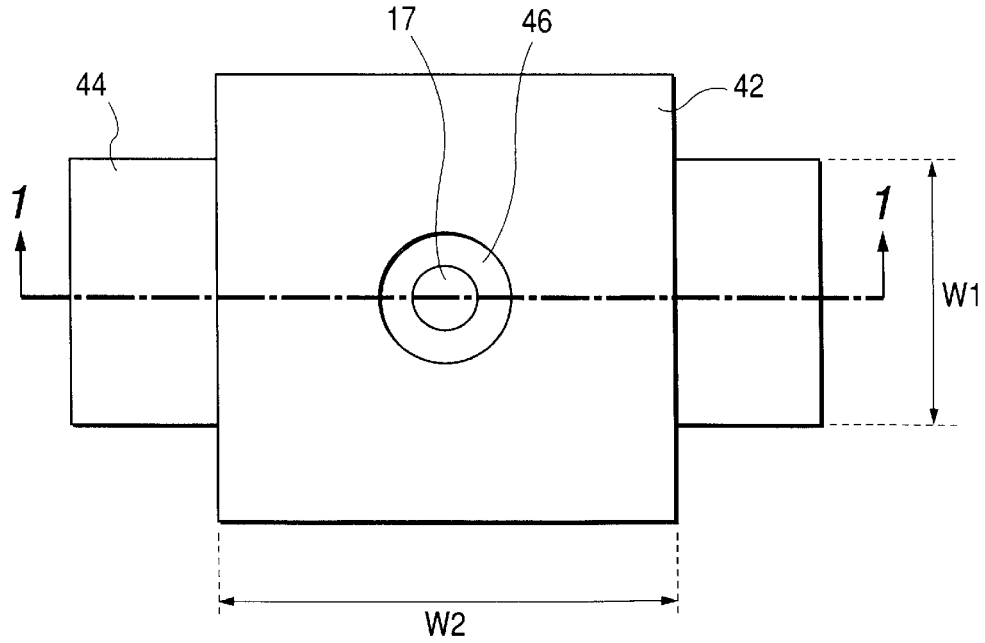
FIG. 2 is a schematic plan view of the electron-emitting device in accordance with the embodiment mode of the present invention.
Figure 3:
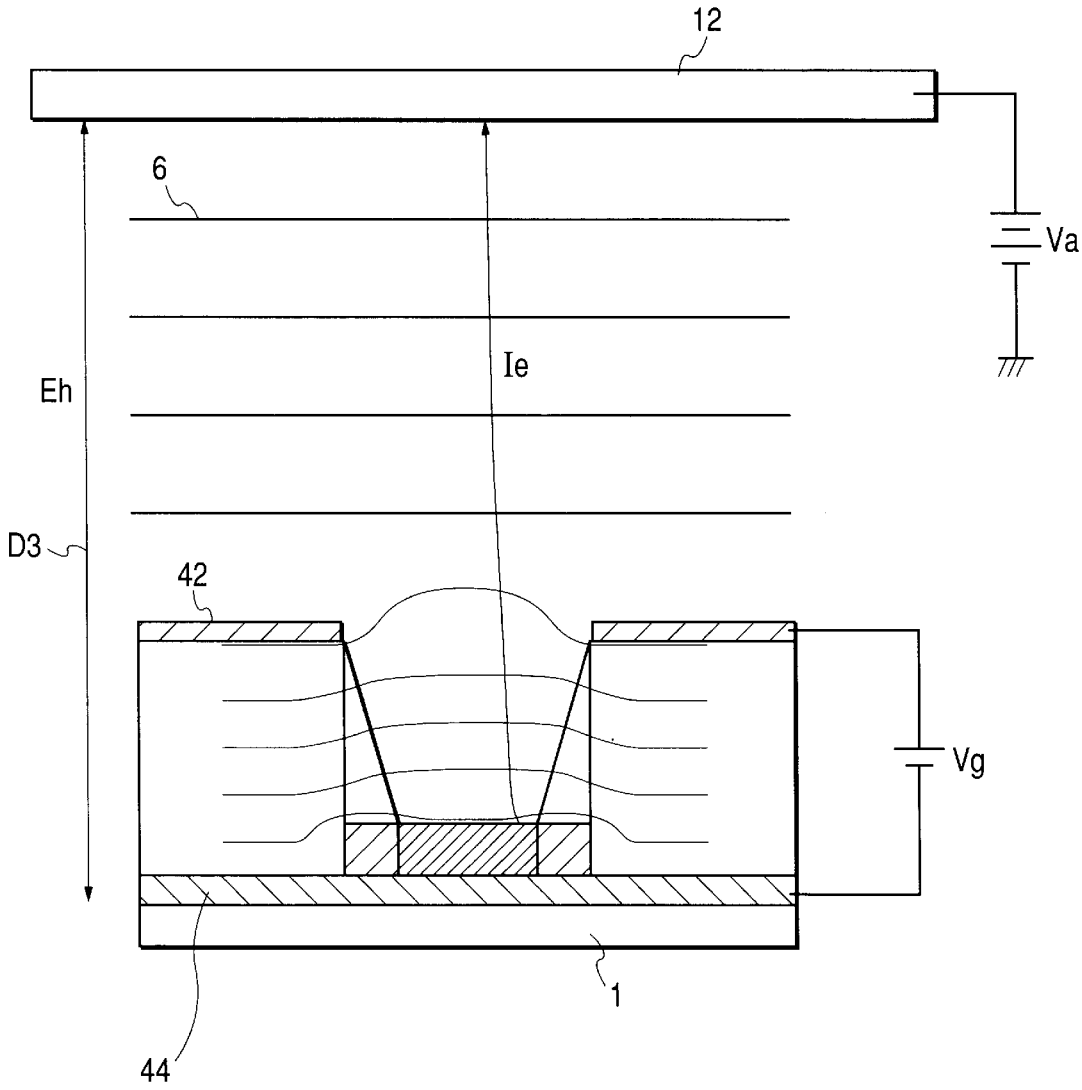
FIG. 3 is a schematic view including equipotential lines indicating a state in which the electron-emitting device in accordance with the embodiment mode of the present invention is driven.

An electron-emitting device in accordance with an embodiment mode of the present invention will be described with reference to FIGS. 1 to 3. FIG. 1 is a schematic sectional view of the electron-emitting device in accordance with the embodiment mode of the present invention. FIG. 2 is a schematic plan view of the electron-emitting device in accordance with the embodiment mode of the present invention. Further, FIG. 1 is equivalent to a sectional view along the line 1—1 in the plan view of FIG. 2. In addition, FIG. 3 is a schematic view including equipotential lines showing a state in which an anode is disposed opposing the device of the present invention to drive the device.

As shown in the figure, the electron-emitting device has a structure in which a first electrode layer 42, a first insulating layer 43, a second electrode layer 44, a third electrode layer 45 and a second insulating layer 46 are laminated on a substrate 1.

This laminated structure will be described more in detail. The electron-emitting device has a structure in which the second electrode layer 44 is disposed on the substrate 1, the first insulating layer 43 is disposed on the second electrode layer 44 to have an opening, and the first electrode layer 42 is further disposed on the first insulating layer 43 to have an opening in the same manner, whereby the first insulating layer 43 is sandwiched between the first electrode layer 42 and the second electrode layer 44.

The second insulating layer 46 is included in the opening that is formed to perforate through the first electrode layer 42 and the first insulating layer 43, and the second insulating layer 46 is provided with an opening having a taper such that an opening area is gradually getting smaller from the first electrode layer 42 side to the second electrode layer 44 side.

The third electrode layer 45 is provided between the second insulating layer 46 and the second electrode layer 44. The third electrode layer 45 is also provided with an opening, in which an electron-emitting layer (electron-emitting film) 17 as an electron-emitting material is formed.

Here, the first electrode layer 42 is a layer from which electrons are not emitted and is formed of a conductive material different from those used in the second electrode layer 44, the third electrode layer 45 and the electron-emitting layer 17. However, the conductive materials may be the same. In addition, although the electron-emitting material is preferably a conductor, a dielectric material has the same effects.

In addition, in the figure, reference character W1 denotes a width of the second electrode layer 44 and the electron-emitting layer 17, W2 denotes a width of the first electrode layer 42, and W3 denotes a size (a diameter in case of a circle, a length of one side in case of a square) of the opening. In addition, reference character D1 denotes a thickness of the first electrode layer 42, D2 denotes a thickness of the insulating layer 43, D3 denotes a distance between the anode 12 and the second electrode layer 44 to be a low potential electrode, D4 denotes a thickness of the second electrode layer 44, and D5 denotes a thickness of the third electrode layer 45.

Reference character Vg denotes a voltage applied between the first electrode layer 42 and the second electrode layer 44 (including the electron-emitting layer 17). Va denotes a potential applied to the anode 12, typically a voltage applied between the GND and the anode 12 or a voltage applied between the second electrode layer 44 and the anode 12. Ie denotes an electron emission current. In addition, Eh denotes an electric field formed by Vg and reference numeral 6 denotes equipotential surfaces.

With the above-mentioned configuration, when Vg and Va are applied to drive the device, the electric field Eh is formed and a shape of the equipotential surfaces 6 inside the opening is defined based on Vg, D2, W2, the shape of the opening, a dielectric constant of the insulating layer and the like. In addition, the equipotential surfaces 6 are substantially parallel mainly by D3 and Va outside the opening.

Further, according to a structure and a shape of the electron-emitting device in accordance with the embodiment mode of the present invention, an equipotential surface is formed in a recessed (concave) shape on the electron-emitting film 17 as shown in FIG. 3.

This is an effect mainly by the opening of a taper shape provided in the second insulating layer 46 and the third electrode layer 45. This is because the parallel equipotential surfaces in the outside of the opening (in the first insulating layer) are lifted by the third electrode layer 45 and the insulating layer covering the third electrode layer 45, whereby inclination is formed in the equipotential surfaces by the insulating layer of a taper shape contacting the vacuum.

Here, since the equipotential surfaces are pressed downward on the boundary between the second insulating layer 46 having the taper shaped opening and the vacuum area, the equipotential surfaces are bent downward in that part and, as a result, the equipotential surface has a recessed (concave) shape on the surface of the electron-emitting film. This is because the dielectric constant of the second insulating layer is high compared with the dielectric constant of the vacuum.

Figure 4A:
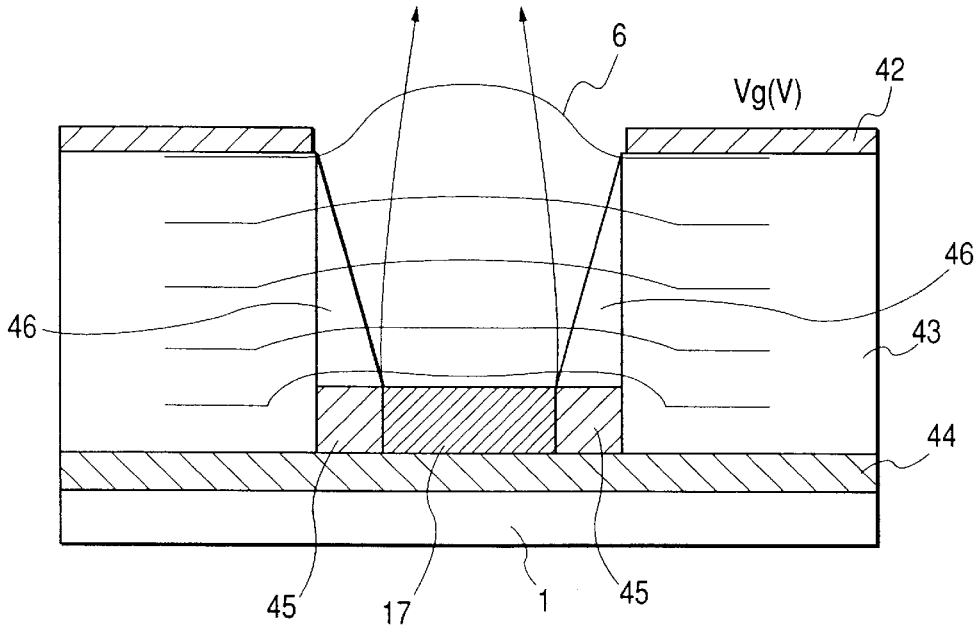
FIGS. 4A and 4B are schematic views indicating a trajectory of emitted electrons.
Figure 4B:
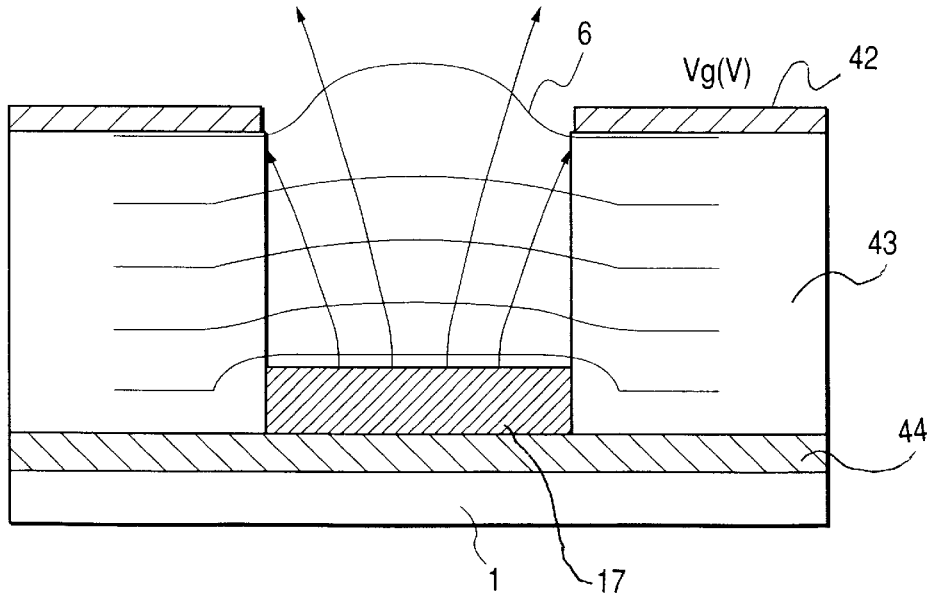

A trajectory of electrons emitted from the electron-emitting device in accordance with the embodiment mode of the present invention will be described with reference to FIGS. 4A and 4B. FIGS. 4A and 4B show a result of simulating trajectories of emitted electrons in the opening in the electron-emitting device. FIG. 4A shows trajectories of the electrons in case of the structure of this embodiment mode and FIG. 4B shows trajectories of emitted electrons in an electron-emitting device disclosed in Japanese Patent Application Laid-open No. 8-96704 or the like for comparison purposes.

As shown in the figure, in FIG. 4B, the equipotential surfaces are formed in a protruded (convex) shape from the electron-emitting film 17 side toward the gate electrode 42 side. Thus, electrons emitted to the vacuum take trajectories to the outside and electrons emitted from the circumference of the electron-emitting film 17 collide with the insulating layer in the circumference of the opening or the first electrode layer and scatter, whereby the trajectories of the electrons largely spread. Moreover, since trajectories of electrons that do not scatter also spread to the outside, a beam diameter is enlarged.

On the other hand, in the electron-emitting device of the present invention shown in FIG. 4A, it can be seen that, since the equipotential surfaces in a recessed shape are formed on the electron-emitting film 17, electrons can go out of the opening without colliding with the second insulating layer or the first electrode layer around the opening and scattering even if the electrons are emitted from the circumference of the electron-emitting film. Thus, the electron-emitting device of the present invention has an effect of focusing electron beams. If the dielectric coefficient of the second insulating layer 46 is set to be larger than that of the first insulating layer 43, a better effect of focusing electron beams can be realized.

The electrons that have exited the opening are then accelerated in the Y direction by Va and collide with a phosphor plate. The electrons in the X direction that affects spreading of beams can be approximated by a uniform motion of an initial velocity Vx in the X direction when the electrons have exited the opening.

Here, reducing a beam diameter is important for suppressing a scattering component and reducing Vx, whereby scattering can be suppressed and low Vx can be realized in the embodiment mode of the present invention.

Further, the other beam sizes tend to be enlarged in accordance with the increase in the electric field Eh and the decrease in Va. These parameters become matters of design for selecting preferred values for an application of the electron-emitting device.

As described above, in the electron-emitting device in accordance with the embodiment mode of the present invention, since it is possible to suppress scattering to take out electrons, substantially all the emitted electrons become Ie and efficiency is high even under a low voltage.

In addition, since potential distortion is small between the electron-emitting device and the anode and a potential distribution of a recessed shape is formed, electrons emitted to the vacuum advances toward the anode without changing the direction. Further, since spread of electron beams is small, the electron beam diameter is small. Moreover, since the emitted electrons advance along the potential distribution of a recessed shape, the electrons do not scatter on surrounding walls, spread of the electron beams can be suppressed as designed.

In addition, since an electron-emitting area of the electron-emitting device in accordance with the embodiment mode of the present invention is the entire surface of the electron-emitting layer 17 and is large, the electron-emitting device is durable against impact of ions existing in the vacuum.

Moreover, since an obstacle disturbing the trajectory of electrons heading for the anode and a potential to be an obstacle do not exist, substantially all the emitted electrons become an electron emission current. Thus, highly efficient electron emission becomes possible under a low voltage.

Furthermore, since the electron-emitting device in accordance with the embodiment mode of the present invention has a very simple configuration in which stacking of layers is repeated, the manufacturing process is easy and the electron-emitting device can be manufactured with a good yield.

Thus, since, the electric filed emission electron-emitting device like the electron-emitting device of the embodiment mode of the present invention has a small electron beam diameter and a large electron-emitting area, can emit electrons with a high efficiency under a low voltage and can be manufactured by an easy manufacturing process, the electron-emitting device can be applied to an image-forming apparatus such as a display.

Further, although the example in which an insulating layer is configured of the first insulating layer 43 and the second insulating layer 46 is described for convenience of explanation, a material for the first insulating layer and a material for the second insulating layer are not necessarily different in realizing the above-mentioned effects. Thus, although manufacturing of the insulating layer may be divided into a manufacturing process of the first insulating layer and a manufacturing process of the second insulating layer, it is not always required to be divided. Therefore, the present invention is not limited to the case in which the first insulating layer and the second insulating layer are configured as separate members.

Thus, it is sufficient for the electron-emitting device in the present invention to have a configuration in which, as shown in FIG. 1 and other figures, an insulating layer having an opening is disposed between the first electrode (gate electrode) 42 and the second electrode (cathode electrode) 44, the opening of the insulating layer is formed in a taper shape with an opening area on the first electrode layer side larger than that on the second electrode side, and the outer circumference of the electron-emitting film (or the third electrode surrounding the outer circumference of the electron-emitting film) is sandwiched between the insulating layer and the second electrode layer.

Then, it is sufficient to appropriately determine whether or not the insulating layer is configured of a plurality of insulating layers depending on a manufacturing process to be used.

In addition, in such a case in which a material having a dielectric constant higher than that of the material of the first insulating layer 43 is used as the material of the second insulating layer 46 for the purpose of improving the focusing effect of electron beams as described above, it is preferable to divide the insulating layer into the first insulating layer and the second insulating layer for convenience of a manufacturing process. In this case, a clear boundary area dividing the first insulating layer and the second insulating layer is often formed structurally.

An example of a manufacturing method of the electron-emitting device in accordance with the embodiment mode of the present invention will now be described more in detail with reference in particular to FIGS. 5A to 5D. FIGS. 5A to 5D show views of steps indicating an example of the manufacturing method of the electron-emitting device in accordance with the embodiment mode of the present invention. Further, it is needless to mention that the present invention is not limited to this manufacturing method. In particular, orders of deposition and etching methods according to different structures will be described separately in an embodiment mode.

First, the second electrode layer 44 is disposed on the substrate 1 using any one of quartz glass, glass with a reduced amount of impurities such as Na, soda lime glass, a laminated body with $SiO_2$ disposed on a silicon substrate or the like by a sputtering method or the like, and an insulating substrate of ceramics such as aluminum, surfaces of which are sufficiently cleaned in advance, as the substrate 1.

The second electrode layer 44 generally has conductivity and is formed by a general vacuum deposition method such as an evaporation method and the sputtering method. A material for the second electrode layer 44 is appropriately selected from, for example, a metal or alloy material such as Be, Mg, Ti, Zr, Hf, V, Nb, Ta, Mo, W, Al, Cu, Ni, Cr, Au, Pt and Pd, a carbide such as TiC, ZrC, HfC, TaC, SiC and WC, a boride such as $HfB_2$, $ZrB_2$, $LaB_6$, $CeB_6$, $YB_4$ and $GdB_4$, a nitride such as TiN, ZrN and HfN, a semiconductor such as Si and Ge, an organic polymer material, amorphous carbon, graphite, diamond-like carbon, diamond dispersed carbon and carbon compound, and the like. The thickness of the second electrode layer 44 is set in the range of several ten nm to several nm and is preferably selected from the range of several hundred nm to several $\mu$m.

Figure 5A:
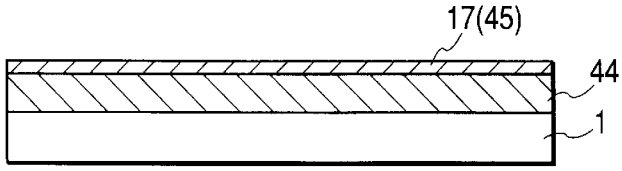
FIGS. 5A, 5B, 5C and 5D are views showing manufacturing steps of the electron-emitting device in accordance with the embodiment mode of the present invention.

Then, as shown in FIG. 5A, the third electrode layer 45 and the electron-emitting layer 17 are subsequently deposited on the second electrode layer 44 as the same material.

The third electrode layer 45 and the electron-emitting layer 17 are formed by the general vacuum deposition method such as an evaporation method and the sputtering method or a photolithography technology.

The material for the third electrode layer 45 and the electron-emitting layer 17 is appropriately selected from, for example, diamond dispersed carbon and carbon compound, amorphous carbon, graphite, diamond-like carbon and the like. Preferable, a diamond thin film, diamond-like carbon and the like with a low work function are better.

The film thickness of the third electrode layer 45 and the electron-emitting layer 17 is set in the range of several nm to several hundred nm and is preferably selected from the range of several nm to several ten nm.

Further, photolithography and etching processes may be performed collectively after disposing the electron-emitting layer 17 and the second electrode layer 44 (FIG. 5B), or these processes may be performed separately.

In addition, the third electrode layer 45 and the electron-emitting layer 17 may not be formed simultaneously. For example, only the third electrode layer 45 is formed first without depositing the electron-emitting layer 17. Then a diamond thin film, diamond-like carbon or the like may be selectively deposited as the electron-emitting layer 17 on the second electrode layer 44 after forming the opening.

The insulating layer 43 is subsequently deposited. The insulating layer 43 is formed by the general vacuum deposition method such as the sputtering method, a CVD method and a vacuum evaporation method. Its thickness is set in the range of several nm to several $\mu$m and is preferably selected from the range of several ten nm to several hundred nm. A material with high voltage tightness that can withstand a high electric field such as $SiO_2$, SiN, $Al_2O_3$, CaF, and undorped diamond is desired.

Moreover, the first electrode layer 42 is deposited subsequently to the insulating layer 43. The first electrode layer 42 has conductivity as the second electrode layer 44 does and is formed by the general vacuum deposition method such as the evaporation method and the sputtering method or the photolithography technology.

The material of the first electrode layer 42 is appropriately selected from, for example, a metal or alloy material such as Be, Mg, Ti, Zr, Hf, V, Nb, Ta, Mo, W, Al, Cu, Ni, Cr, Au, Pt and Pd, a carbide such as TiC, ZrC, HfC, TaC, SiC and WC, a boride such as $HfB_2$, $ZrB_2$, $LaB_6$, $CeB_6$, $YB_4$ and $GdB_4$, a nitride such as TiN, ZrN and HfN, a semiconductor such as Si and Ge, an organic polymer material, and the like. The thickness of the first electrode layer 42 is set in the range of several nm to several $\mu$m and is preferably selected from the range of several nm to several hundred nm.

Further, the first electrode layer 42 and the second electrode layer 44 may be formed of an identical material or different kinds of materials, and may be formed by an identical forming method or different kinds of forming methods.

Figure 5B:
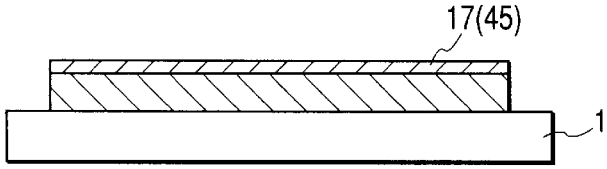
Figure 5C:
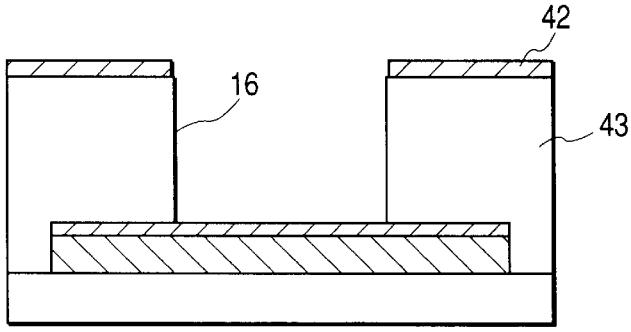

Next, as shown in FIG. 5C, an opening pattern 16 is formed by the photolithography technology.

Figure 5D:
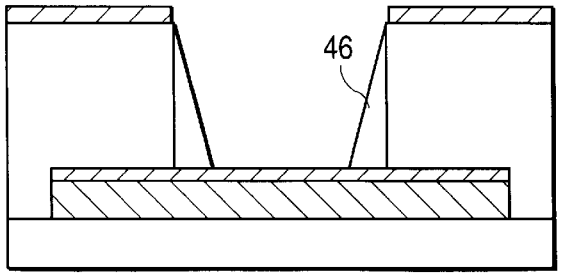

Then, as shown in FIG. 5D, the second insulating layer 46 having a taper shape in the circumference of the opening is formed by the an etchback method after the second insulating layer is stacked, whereby the device is completed.

A smooth and vertical etching surface is desired for an etching process, and an etching method may be selected according to a material of each layer. Here, the taper shape is particularly important on a side close to the second electrode layer 46 on the cathode side. Thus, the effects of the present invention is effective without being harmed even in the case in which the second insulating layer 46 is in a reverse taper shape or a vertical (cylindrical) shape on the side close to the first electrode layer 42 or the second insulating layer 46 does not exist on the side close to the first electrode layer 42.

Preferably, the upper surface of the electron-emitting layer 17 is provided lower than the upper surface of the second electrode layer 44, that is, the lower surface of the second insulating layer 46. Thus, it becomes possible to make the equipotential surfaces to be more recessed, and more preferable form of the device is realized.

As described above, there is also a manufacturing method for selectively depositing the electron-emitting layer 17 on the second electrode layer 44 in the end. In doing so, it is necessary to form the third electrode layer 45 under the second insulating layer 46 in advance.

The width W1 of the second electrode layer 44 (including the electron-emitting layer 17) is appropriately set according to a material forming the device and its value of resistance, a work function and a driving voltage of the material of the second electrode layer 44, and a required shape of electron-emitting beams.

Usually, W1 is selected from the range of several hundred nm to several hundred $\mu$m. The width W2 of the first electrode layer 42 is appropriately set according to a material forming the electron-emitting device and its value of resistance and an arrangement of the device. Usually, W2 is selected from the range of several hundred nm to several hundred $\mu$m.

Figure 6:
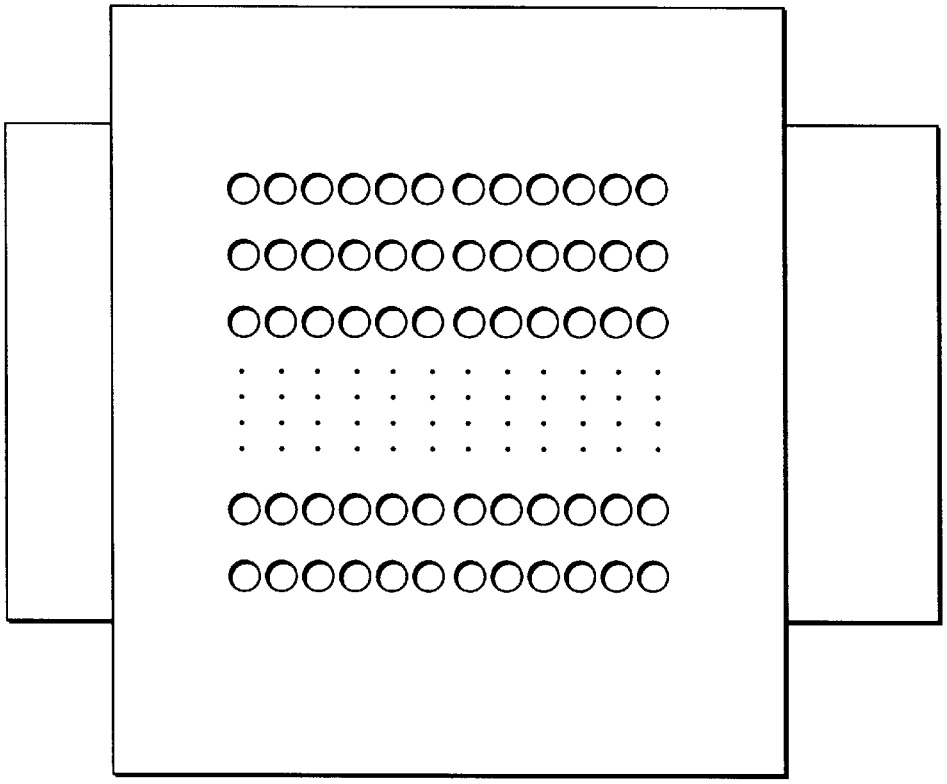
FIG. 6 is a schematic plan view of the electron-emitting device in accordance with the embodiment mode of the present invention.

In addition, a plurality of the above-mentioned opening may be arranged to form one pixel as shown in FIG. 6.

The size W3 of the opening is appropriately set according to the material forming the device and its value of resistance, a work function and a driving voltage of the material of the second electrode layer 44, and a required shape of electron-emitting beams. Usually, W3 is selected from the range of several hundred nm to several ten $\mu$m. In the embodiment mode of the present invention, there is a large effect in making the beam diameter smaller, and the smaller W1 to W3 the larger the effect.

An example to which the electron-emitting device in accordance with the embodiment mode of the present invention are applied will now be described. In this example, a plurality of the electron-emitting devices in accordance with the embodiment mode of the present invention are arranged on a substrate, whereby, for example, an electron source or an image-forming a pparatus can be configured.

Various arrangements of the electron-emitting devices are employed. As an example, there is a simple matrix arrangement in which a plurality of electrode-emitting devices are arranged in a matrix shape in the X direction and the Y direction, and one group of the electrodes of the plurality of electron-emitting devices arranged on a same row is commonly connected to wiring in the X direction and the other group of the electrodes of the plurality of electron-emitting devices arranged on a same column is commonly connected to wiring in the Y direction. The matrix arrangement will be hereinafter described in detail.

An electron source to be obtained by arranging a plurality of the electron-emitting devices in accordance with the embodiment mode of the present invention will be hereinafter described with reference to FIG. 7.

Figure 7:
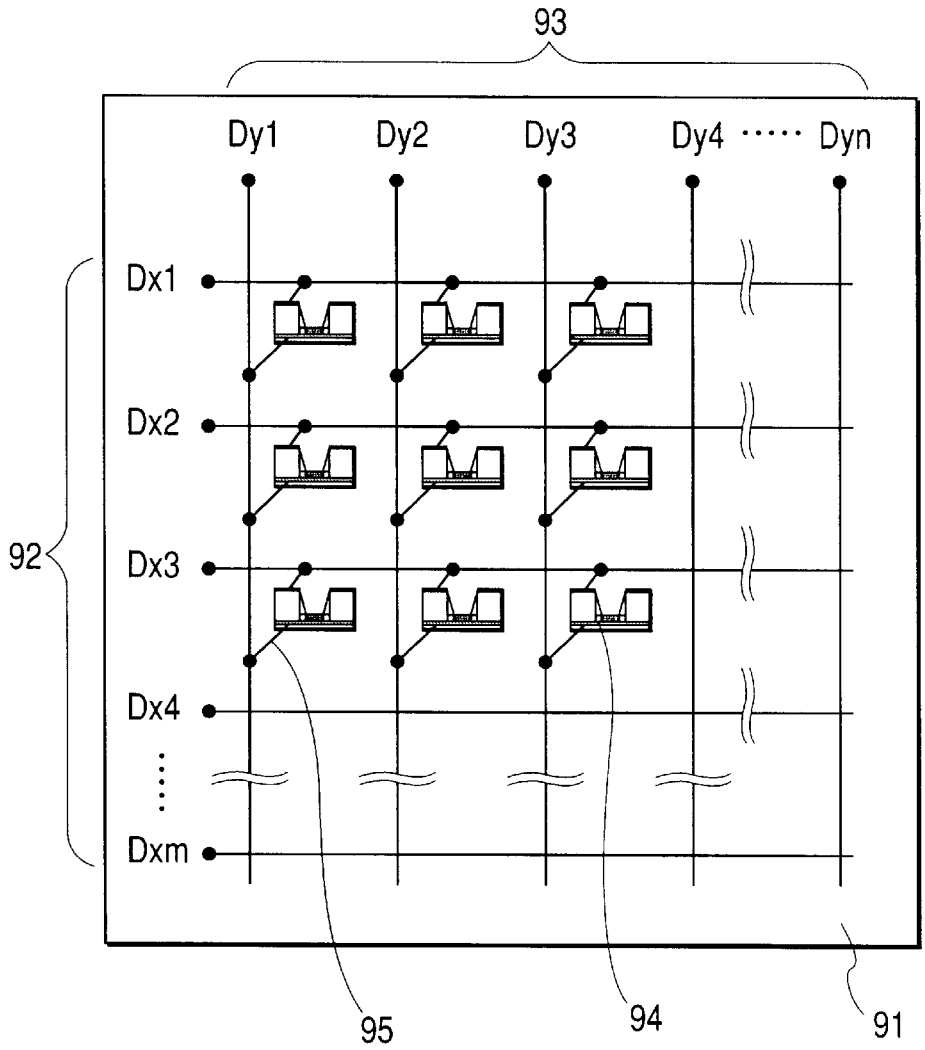
FIG. 7 is a schematic plan view of an electron source in accordance with the embodiment mode of the present invention.

In FIG. 7, reference numeral 91 denotes an electron source substrate, 92 denotes X direction wiring, 93 denotes Y direction wiring, 94 denotes the electron-emitting devices in accordance with the embodiment mode of the present invention, and 95 denotes a connection.

M pieces of X direction wiring 92 consists of Dx1, Dx2, . . . , Dxm and can be formed of a conductive metal or the like formed by using the vacuum evaporation method, a printing method, the sputtering method or the like. A material, a film thickness and a width of the wiring are appropriately designed. The Y direction wiring 93 consists of n pieces of wiring, Dy1, Dy2, . . . Dyn, and is formed in the same manner as the X direction wiring 92. A not-shown inter-layer insulating layer is provided between the m pieces of X direction wiring 92 and the n pieces of Y direction wiring 93 and separates the both pieces of wiring electrically (both m and n are positive integers).

The not-shown inter-layer insulating layer is formed of $SiO_2$ or the like that is formed by using the vacuum evaporation method, the printing method, the sputtering method or the like. For example, the inter-layer insulating layer is formed in a desired shape on the entire surface or a part of the substrate 91 on which the X direction wiring 92 is formed. In particular, a film thickness, a material and a manufacturing method are appropriately set such that the inter-layer insulating layer can withstand a difference of potentials at an intersection of the X direction wiring 92 and the Y direction wiring 93. The X direction wiring 92 and the Y direction wiring 93 are drawn out as an external terminal, respectively.

Pairs of electrodes (not shown) forming the electron-emitting devices 94 are electrically connected with the m pieces of X direction wiring 92 and the n pieces Y direction wiring 93 via the connections 95 made of a conductive metal or the like.

In a material forming the X direction wiring 92 and the Y direction wiring 93, a material forming the connection 95 and a material forming the pair of electrodes, a part or all elements of the materials may be identical or may be different from each other. These materials are appropriately selected from, for example, the materials of the above-mentioned device electrodes (the first electrode layer 42 and the second electrode layer 44). If the material forming the device electrodes and the wiring material are identical, it can be said that the wiring connected to the device electrodes is the device electrode.

Not-shown scanning signal applying means, which applies a scanning signal for selecting a row of the electron-emitting devices 94 arranged in the X direction, is connected to the X direction wiring 92. On the other hand, not-shown modulating signal generating means, which modulates each column of the electron-emitting devices 94 arranged in the Y direction according to an input signal, is connected to the Y direction wiring 93. A driving voltage applied to each electron-emitting device is supplied as a differential voltage between a scanning signal and a modulating signal applied to the device.

In the above-mentioned configuration, individual devices can be selected and can be independently driven using matrix wiring.

Figure 8:
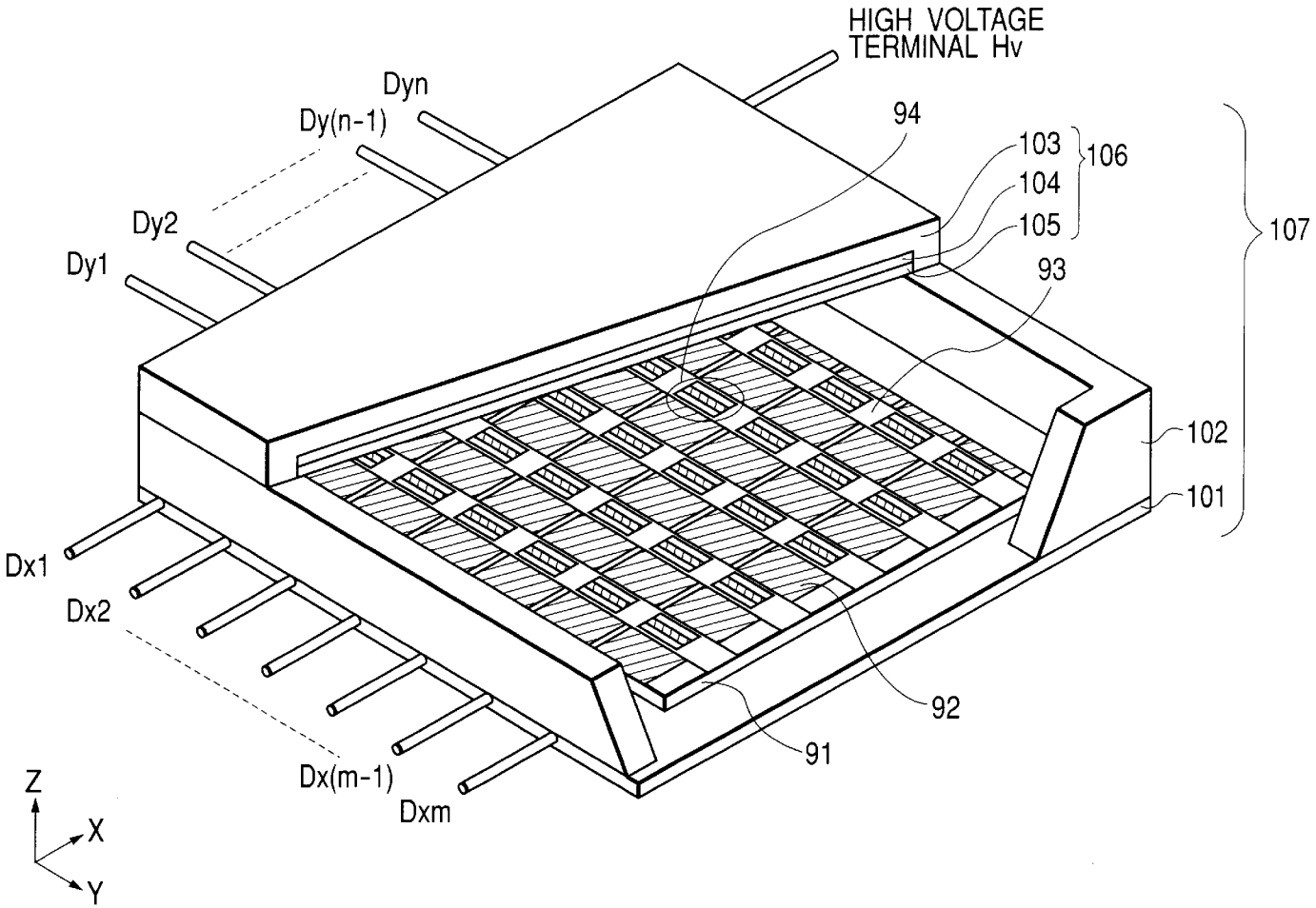
FIG. 8 is a schematic (partially cut off) perspective view of an image-forming apparatus in accordance with the embodiment mode of the present invention.

An image-forming apparatus formed by using the electron source of such matrix wiring will now be described with reference to FIG. 8. FIG. 8 is a schematic view showing an example of a display panel of the image-forming apparatus.

In FIG. 8, reference numeral 91 denotes an electron source substrate on which a plurality of electron-emitting devices are arranged, 101 denotes a rear plate on which the electron source substrate 91 is fixed, and 106 denotes a face plate in which a fluorescent film 104 as a phosphor being an image-forming member, a metal back 105 and the like are formed on an internal surface of a glass substrate 103.

Reference numeral 102 denotes a supporting frame, to which the rear plate 101 and the face plate 106 are connected using frit glass, etc. Reference numeral 107 denotes an envelope, which is formed by being baked for 10 minutes or more in a temperature range of 400 to 500° C. in the atmosphere or nitrogen to be sealed.

Reference numeral 94 corresponds to the electron-emitting device in FIG. 1. Reference numerals 92 and 93 denote X direction wiring and Y direction wiring connected to a pair of device electrodes (the first electrode layer 42 and the second electrode layer 44) of the electron-emitting device.

As described above, the envelope 107 is configured of the face plate 106, the supporting frame 102 and the rear plate 101. Here, since the rear plate 101 is provided mainly for reinforcing the substrate 91, the separate rear plate 101 is not necessary if the substrate 91 itself has sufficient strength. That is, the supporting frame 102 may be directly bonded on the substrate 91 to configure the envelope 107 by the face plate 106, the supporting frame 102 and the substrate 91.

On the other hand, a not-shown supporting body called a spacer is provided between the face plate 106 and the rear plate 101, whereby the envelope 107 having sufficient strength against the atmospheric pressure can be configured.

Further, in the image-forming apparatus using the electron-emitting device in accordance with the embodiment mode of the present invention, the phosphor (fluorescent film 104) is disposed in alignment above the electron-emitting devices 94 taking a trajectory of emitted electrons into account.

Figure 9A:
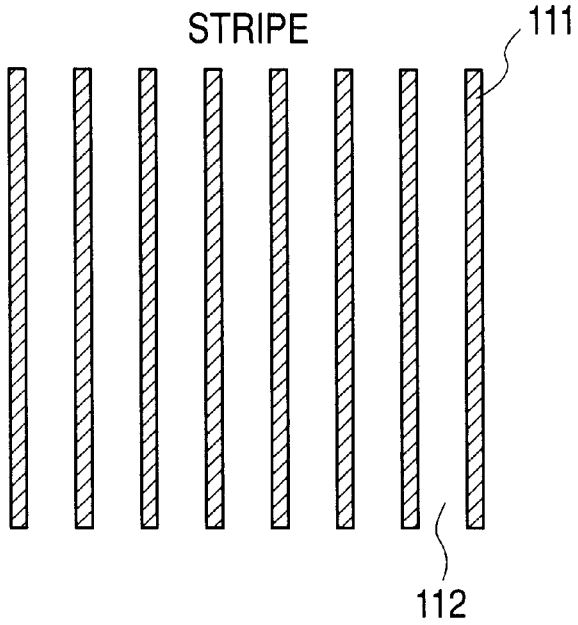
FIGS. 9A and 9B are schematic views showing an example of a fluorescent film.
Figure 9B:
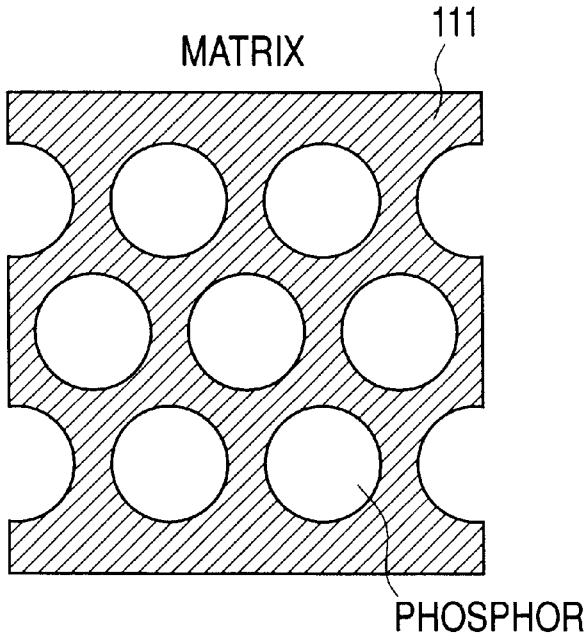

FIGS. 9A and 9B are schematic views showing the fluorescent film 104 used in the panel of this embodiment mode. In case of a color fluorescent film, it is configured of a black conductive material 111, which is called a black stripe shown in FIG. 9A or a black matrix shown in FIG. 9B, and a phosphor 112.

Purposes of providing the black stripe or the black matrix are to make mixed colors or the like less noticeable by blacking a dividing part between each phosphor 85 among required phosphors of primary colors and to suppress decline of contrast due to reflection of external light on the fluorescent film 104. As a material for the black stripe, a material with conductivity and less transmission and reflection of light can be used other than a material with graphite as a main component which is usually used.

As a method of applying a phosphor on the glass substrate 103, a precipitation method, the printing method or the like regardless of whether the phosphor is monochrome or color.

The metal back 105 is usually provided on the internal surface side of the fluorescent film 104. Purposes of providing the metal back are to improve luminance by mirror-reflecting light to the internal surface side among lights emitted by the phosphor to the face plate 106 side, to cause the metal back 105 act as an electrode for applying an electron beam accelerating voltage, to protect the fluorescent film 104 from damages due to collision of minus ions generated inside the envelope, and the like.

The metal back 105 can be manufactured by performing smoothing processing (usually called "filming") of the internal surface of the fluorescent film after manufacturing it and thereafter depositing A1 on it using the vacuum evaporation or the like.

A transparent electrode (not shown) may be provided on the external surface side of the fluorescent film 104 in the face plate 106 in order to further increase conductivity of the fluorescent film 104.

In the embodiment mode of the present invention, since an electron beam reaches immediately above the electron-emitting devices 94, the image-forming apparatus is configured with the electron-emitting devices 94 positioned such that the fluorescent film 104 is disposed immediately above it.

A vacuum seal process for sealing the envelope (panel) to which the sealing process has been applied will now be described.

The vacuum seal process is to heat the envelope (panel) 107, and, while maintaining it at a temperature of from 80 to 250° C., exhaust the envelope 107 through an exhaust pipe (not shown) by an exhausting apparatus such as an ion pump and a sorption pump to turn the inside of the envelope 107 into the atmosphere with sufficiently few organic substances and then complete sealing by melting the exhaust pipe by heating it with a burner.

In order to maintain the pressure after sealing the envelope 107, getter processing may also be performed. This is processing for heating a getter disposed in a predetermined position (not shown) inside the envelope 107 using resistance heating, high frequency heating or the like to form an evaporation film immediately before or after sealing the envelope 107.

The getter usually contains Ba or the like as a main component and maintains the atmosphere inside the envelope 107 by absorbing effect of the evaporation film.

In the image-forming apparatus that is configured using the electron source of the passive matrix arrangement, which is manufactured according to the above-mentioned processes, emission of electrons is caused by applying a voltage to each electron-emitting device via outside terminals Dx1 to Dxm and Dy1 to Dyn.

That is, the image-forming apparatus applies a high voltage (Va) to the metal back 105 or the transparent electrode (not shown) via high voltage terminals 113 and accelerates electron beams.

The accelerated electrons collide with the fluorescent film 104, whereby light is emitted and an image is formed.

An example of a configuration of a driving circuit, which displays an image on a television based on a television signal of the NTSC system on a display panel configured using the electron source of the passive matrix arrangement, will now be described with reference to FIG. 12.

Figure 12:
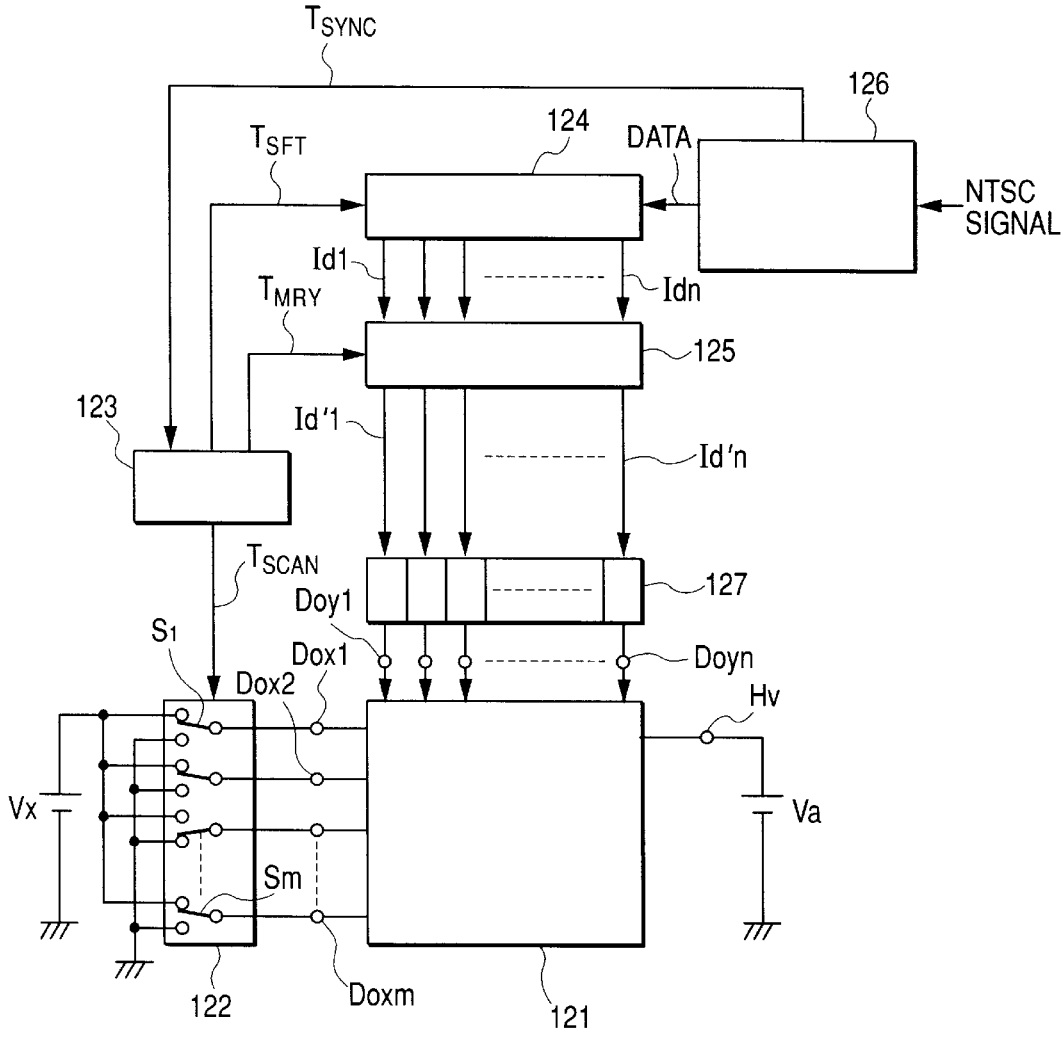
FIG. 12 is a driving circuit diagram of an image-forming apparatus in accordance with the embodiment mode of the present invention.
Figure 13:
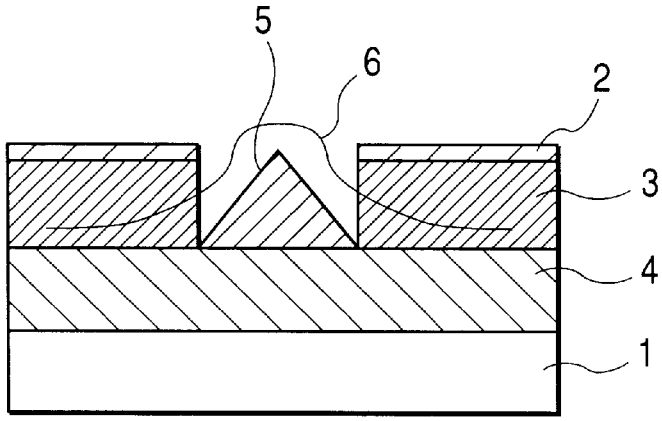
FIG. 13 is a schematic sectional view of an electron-emitting device in accordance with a conventional art.
Figure 14A:
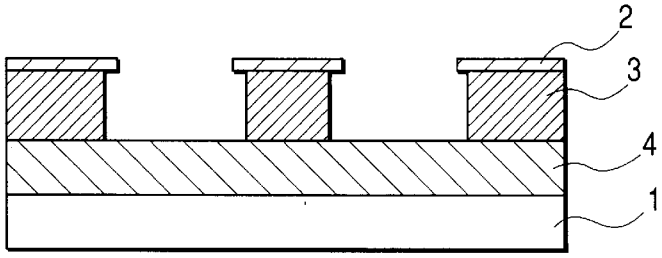
FIGS. 14A, 14B, 14C and 14D are views showing manufacturing steps of the electron-emitting device in accordance with the conventional art.
Figure 14B:
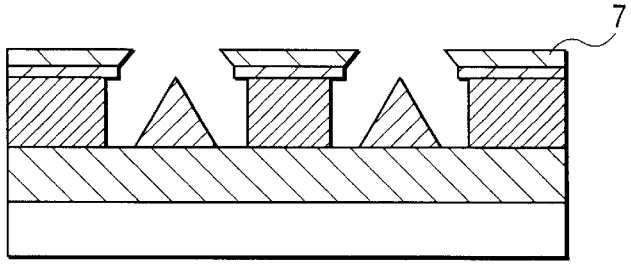
Figure 14C:
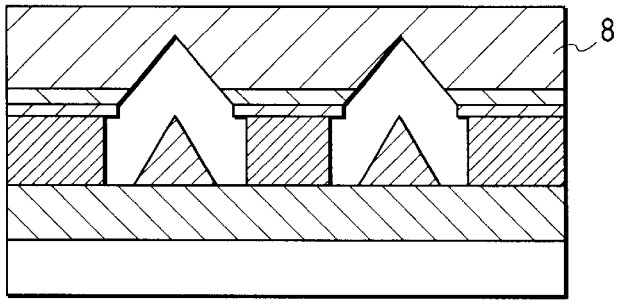
Figure 14D:
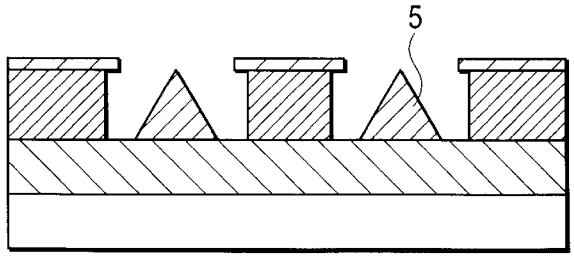
Figure 15:
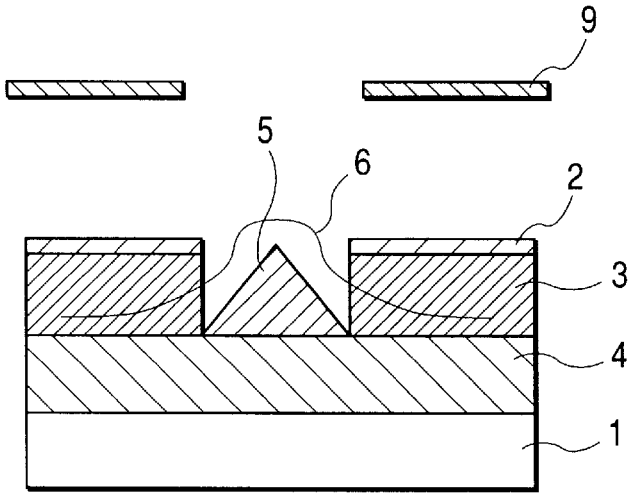
FIG. 15 is a schematic sectional view of an electron-emitting device (provided with a focusing electrode) in accordance with the conventional art.
Figure 16:
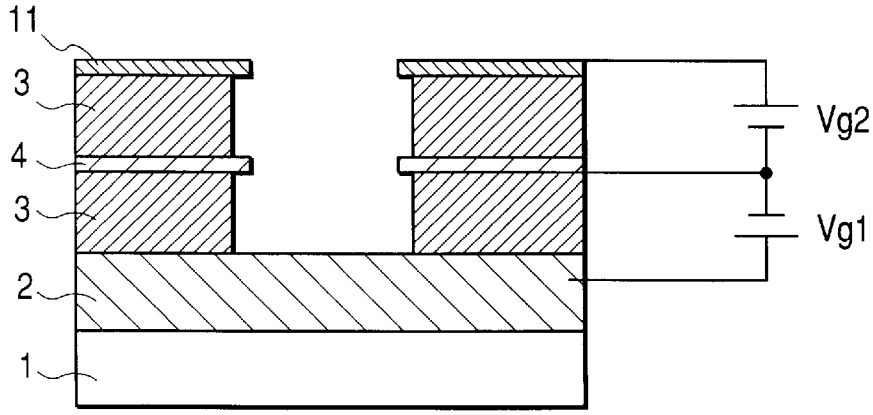
FIG. 16 is a schematic sectional view of the electron-emitting device in accordance with the conventional art.
Figure 17:
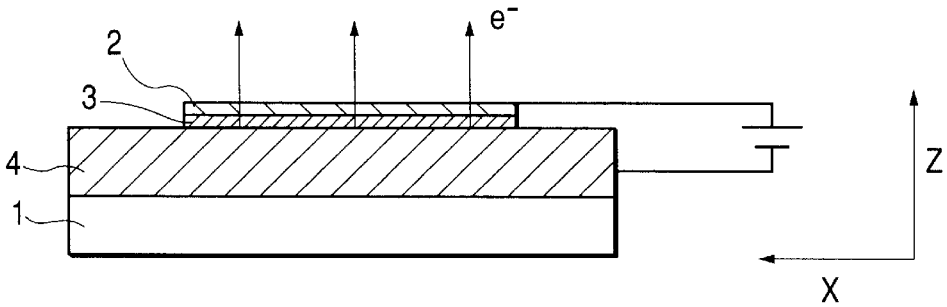
FIG. 17 is a schematic sectional view of an (MIM) electron-emitting device in accordance with the conventional art.
Figure 18:
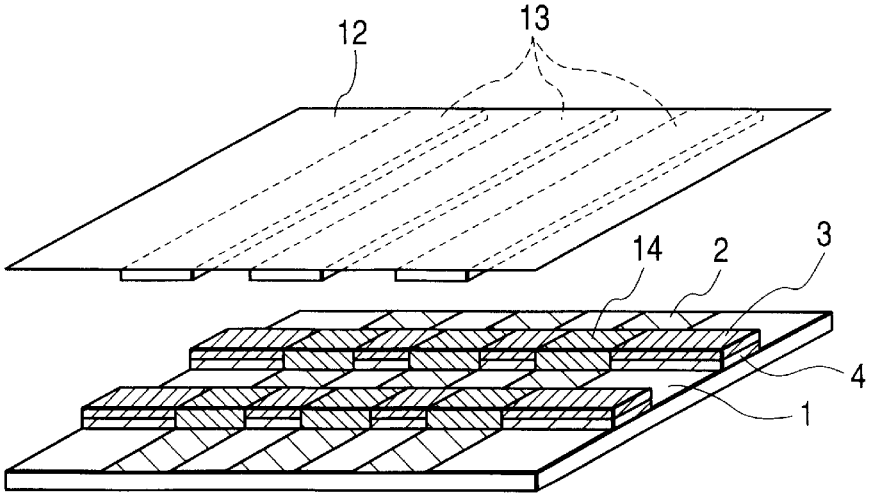
FIG. 18 is a view illustrating the case in which the electron-emitting device in accordance with the conventional art is applied to an image-forming apparatus.

In FIG. 12, reference numeral 121 denotes an image display panel, 122 denotes a scanning circuit, 123 denotes a control circuit, and 124 denotes a shift register. In addition, 125 denotes a line memory, 126 denote a synchronizing signal separation circuit, and 127 denotes a modulation signal generator, and reference characters Vx and Va denote direct current voltage sources.

The display panel 121 is connected to an external electric circuit via terminals Dox1 to Doxm, terminals Doy1 to Doyn and a high voltage terminal Hv. A scanning signal, which drives the electron source provided in the display panel, that is, sequentially drives one row (N devices) of a group of electron-emitting devices that are wired in a matrix shape of M rows and N columns, is applied to the terminals Dox1 to Doxm.

A modulation signal for controlling an output electron beam of each of the electron-emitting devices in one row selected by the scanning signal is applied to the terminals Dy1 to Dyn. A direct current voltage of, for example, 10 K[V] is supplied to the high voltage terminal Hv from the direct current voltage source Va. This direct current voltage is an acceleration voltage for giving sufficient energy for exciting a phosphor to electron beams emitted from the electron-emitting devices.

The scanning circuit 122 will now be described. The circuit is provided with M switching devices inside (in the figure, the switching devices are schematically shown by S1 to Sm). Each switching device selects any one of an output voltage of the direct current voltage source Vx and 0 [V] (ground level) to be electrically connected to the terminals Dx1 to Dxm of the display panel 121.

Each of the switching devices S1 to Sm operates based on a control signal Tscan outputted by the control circuit 123 and can be configured by combining switching devices such as FET.

In the case of this embodiment mode, the direct current voltage source Vx is set so as to output a constant voltage for causing a driving voltage that is applied to a device not scanned based on the characteristics (electron-emitting threshold voltage) of the electron-emitting device to be equal to or less than the electron-emitting threshold voltage.

The control circuit 123 has a function of conforming operations of each portion to each other such that an appropriate image can be displayed based on an image signal inputted from the outside. The control circuit 123 generates each control signal of Tscan, Tsft and Tmry for each portion based on a synchronizing signal Tsync sent from the synchronizing signal separation circuit 126.

The synchronizing signal separation circuit 126 is a circuit for separating a synchronizing signal component and a luminance signal component from a television signal of the NTSC system inputted from the outside and can be configured using a general frequency separation (filter) circuit or the like.

A synchronizing signal separated by the synchronizing signal separation circuit 126 consists of a vertical synchronizing signal and a horizontal synchronizing signal, which is shown here as a Tsync signal for convenience of description. The luminance signal component of an image separated from the television signal is shown as a DATA signal for convenience of description. The DATA signal is inputted in the shift register 124.

The shift register 124 serially or parallelly converting the DATA signal, which is inputted serially in time series, for each line of an image and operates based on a control signal Tsft sent from the control circuit 123 (i.e., it can be said that the control signal Tsft is also a shift clock of the shift register 124).

Data for one line of an image (corresponding to driving data for N electron-emitting devices), which was serially or parallelly converted, is outputted from the shift register 124 as N parallel signals of Id1 to Idn.

The line memory 125 is a storage apparatus for storing the data for one line of an image only for a required period of time, which appropriately stores contents of Id1 to Idn in accordance with the a control signal Tmry sent from the control circuit 123. The stored contents are outputted as image data I'd1 to I'dn and inputted in the modulation signal generator 127.

The modulation signal generator 127 is a signal source for appropriately driving and modulating each of the electron-emitting devices according to each of the image data I'd1 to I'dn. A signal outputted by the signal source is applied to the electron-emitting devices in the display panel 121 through the terminals Doy1 to Doyn.

As describe above, the electron-emitting device in accordance with the embodiment mode of the present invention has the following basic characteristics with respect to the emitted current Ie.

There is a clear threshold voltage Vth for emission of electrons, and emission of electrons occurs only when a voltage equal to or higher than Vth is applied. In response to the voltage equal to or higher than the threshold, an emitted current also changes according to change of a voltage applied to the device.

Thus, if a voltage is applied to the device, for example, emission of electrons does not occur even if a voltage lower than an electron-emitting threshold is applied and electron beams are outputted if a voltage equal to or higher than the electron-emitting threshold is applied. In this case, it is possible to control intensity of the outputted electron beams by changing an applied voltage Vf. In addition, if a pulse voltage is applied to the device, it is possible to control intensity of electron beams by changing a height Ph of a pulse and to control a total amount of charge of electron beams to be outputted by changing a width Pw of the pulse.

Therefore, as a system of modulating the electron-emitting device according to an input signal, a voltage modulation system, a pulse width modulation system or the like can be employed. In implementing the voltage modulation system, a circuit of the voltage modulation system, which generates a voltage pulse of a fixed length and appropriately modulates a wave height value of the pulse according to data to be inputted, can be used as the modulation signal generator 127.

In implementing the pulse width modulation system, a circuit of the pulse width modulation system, which generates a voltage pulse of a fixed wave height value and appropriately modulates a width of the voltage pulse according to data to be inputted, can be used as the modulation signal generator 127.

As the shift register 124 and the line memory 125, those of a digital signal type or an analog signal type may be employed. This is because those of any signal type will do as long as serial/parallel conversion or storage of an image signal is performed at a predetermined speed.

If the shift register 124 and the line memory 125 of the digital signal type are used, it is necessary to digitize the output signal DATA of the synchronizing signal separation circuit 126. For this purpose, it is sufficient to provide an A/D converter in an output portion of the synchronizing signal separation circuit 126.

In this connection, a circuit to be used in the modulation signal generator 127 has variations slightly different from each other depending on whether the output signal of the line memory 125 is a digital signal or an analog signal. That is, in the case of the voltage modulation system using a digital signal, for example, a D/A conversion circuit is used in the modulation signal generator 127 and an amplifier circuit is added to it if necessary.

In the case of the pulse width modulation system, for example, a circuit in which a high-speed oscillator, a counter for counting the number of waves to be outputted by the oscillator and a comparator for comparing an output value of the counter and an output value of the memory are combined is used. If necessary, an amplifier for amplifying a voltage of a modulation signal, whose pulse width is modulated, outputted by the comparator to a driving voltage of the electron-emitting device can be added.

In the case of the voltage modulation system using an analog signal, for example, an amplifier circuit using an operational amplifier or the like can be employed in the modulation signal generator 127, and a level shift circuit or the like can be added to it if necessary. In the case of the pulse width modulation system, for example, a voltage control oscillating circuit (VCO) can be employed, and an amplifier for amplifying a modulation signal to a driving voltage of the electron-emitting device can be added to it if necessary.

In an image-forming apparatus to which the electron-emitting devices in accordance with the embodiment mode of the present invention, which can take the above-mentioned configuration, are applicable, emission of electrons occurs by applying a voltage to each electron-emitting device via the external terminals Dox1 to Doxm and Doy1 to Doyn.

A high voltage is applied to the metal back 105 or a transparent electrode (not shown) via the high voltage terminal Hv to accelerate electron beams. The accelerated electrons collide with the fluorescent film 104, whereby light is emitted and an image is formed.

Further, the configuration of the image-forming apparatus described above is only an example of an image-forming apparatus to which the present invention is applicable and can be modified in various ways based on technical thoughts of the present invention.

The input signal is exemplified by a signal of the NTSC system here. However, the input signal is not limited to this, and a TV signal (for example, for a high-definition TV represented by the MUSE system) system consisting of scanning lines more than those of the NTSC system, such as the PAL system and the SECAM system, can also be employed.

In addition, the image-forming apparatus of the present invention can be used as, for example, an image-forming apparatus as an optical printer configured using a photosensitive drum or the like in addition to a display apparatus for television broadcasting and a display apparatus for a television conference system, a computer or the like.

More specific embodiments based on the above-mentioned embodiment mode will be hereinafter described in detail.

(First Embodiment)

A basic configuration and manufacturing method in this embodiment are identical with those shown in FIG. 1, FIG. 2 and FIGS. 5A to 5D referred to in the above descriptions. A manufacturing process of an electron-emitting device in accordance with this embodiment will be hereinafter described in detail.

(Step 1)

First, as shown in FIG. 5A, quartz was used as the substrate 1 and, after washing it sufficiently, Ta of a thickness of 500 nm was disposed as the second electrode layer 44 by the sputtering method, and the electron-emitting layer 17 (third electrode layer 45) of diamond-like carbon including a low resistance diamond film was disposed on the second electrode layer 44 with a thickness in the order of 100 nm by the CVD method. Mixed gas of $CH_4$ and $H_2$ was used as reactive gas.

(Step 2)

Next, as shown in FIG. 5B, spin coating of a positive photoresist (AZ1500/manufactured by Clariant) and a photomask pattern were exposed by photolithography and developed and an electron-emitting layer was dry-etched by $O_2$, and then a Ta electrode layer was dry-etched by gas of $CF_4$ series.

(Step 3)

As shown in FIG. 5C, $SiO_2$ of the 500 nm thickness was deposited as the insulating layer 43 and Ta of the 100 nm thickness was deposited as the first electrode layer 42 in this order. Subsequently, the layers were patterned in the same manner as the photolithography of step 2, and an opening was formed by dry-etching.

(Step 4)

Then, as shown in FIG. 5D, $SiO_2$ was deposited with a thickness of 200 nm as the second insulating layer 46 by the P-CVD method, and then was etched by the etchback method with gas of $Ar/CHF_3/CF_4$ series at 66.5 Pa and RF power of 800 W.

The electron-emitting device manufactured as described above was driven by applying Va as shown in FIG. 3.

A driving voltage was Vg=10V, Va=5 kV and the distance D3 between the electron-emitting device and the anode 12 was 1 mm. Here, an electrode to which a phosphor was applied was used as the anode 12 to observe a size of an electron beam. The electron beam size referred to here was a size of an area where luminance is 10% or more of peak luminance of the phosphor emitting light. As a result, a beam diameter was 200 $\mu$m.

Figure 10:
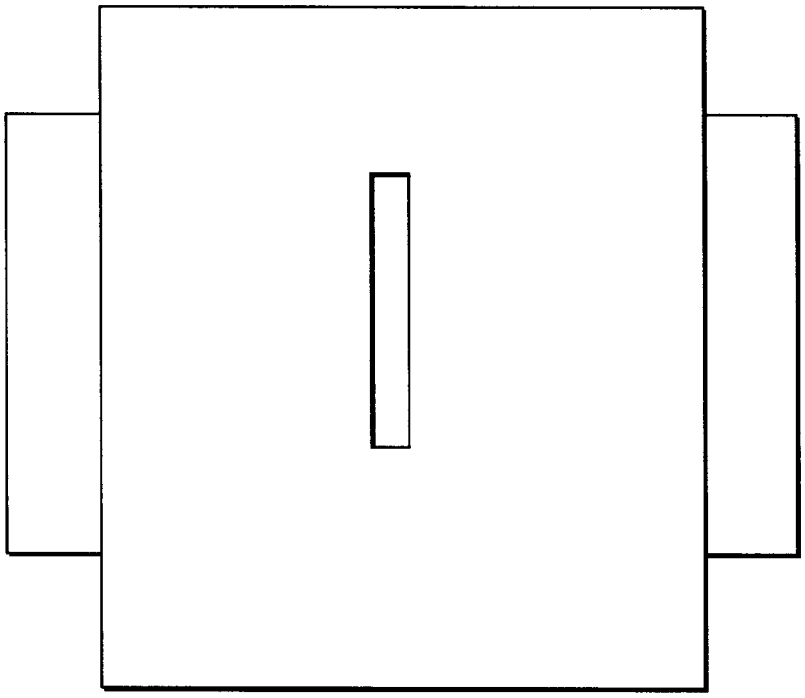
FIG. 10 is a schematic plan view of the electron-emitting device in accordance with the embodiment mode of the present invention.

Although the electron-emitting portion is described as a substantially circular opening here as shown in FIG. 2, it is not limited to this shape. For example, the electron-emitting portion may be formed line-like as shown in the plan view of FIG. 10.

A sectional shape of the line-like opening is the same as that of the circular opening, and the second insulating layer 46 exists on the circumference taper. In this case, same effects were obtained and a beam diameter was successfully reduced. A method of making the opening is the same except that a patterning shape is changed. It is also possible to put a plurality of line patterns side by side to make an emission area larger.

(Second Embodiment)

As a second embodiment, a configuration and a manufacturing method of an electron-emitting device using different materials for the third electrode layer 45 and the electron-emitting layer 17 will be described.

FIGS. 11A to 11E show an example of a manufacturing method of an electron-emitting device in accordance with this embodiment. A manufacturing process of the electron-emitting device in accordance with the present invention will be hereinafter described in detail.

(Step 1)

Figure 11A:
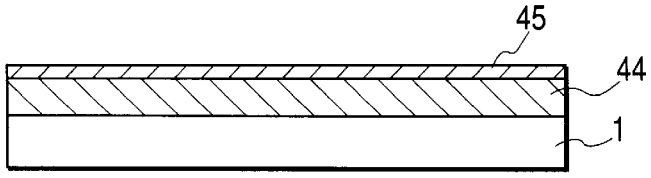
FIGS. 11A, 11B, 11C, 11D and 11E are views showing manufacturing steps of an electron-emitting device in accordance with a second embodiment of the present invention.

First, as shown in FIG. 11A, quartz was used as the substrate 1 and, after washing it sufficiently, Ti of a thickness of 500 nm was stacked as the second electrode layer 44 and Ta of a thickness of 100 nm was stacked as the third electrode layer 45 by the sputtering method.

(Step 2)

Figure 11B:
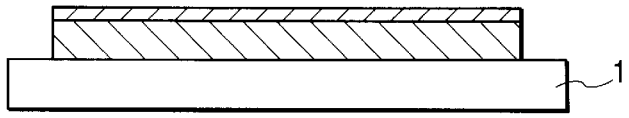

Next, as shown in FIG. 11B, spin coating of a positive photoresist (AZ1500/manufactured by Clariant) and a photomask pattern were exposed by photolithography and developed, and a Ta electrode layer and a Ti electrode layer were dry-etched by gas of $CF_4$ series.

(Step 3)

Figure 11C:
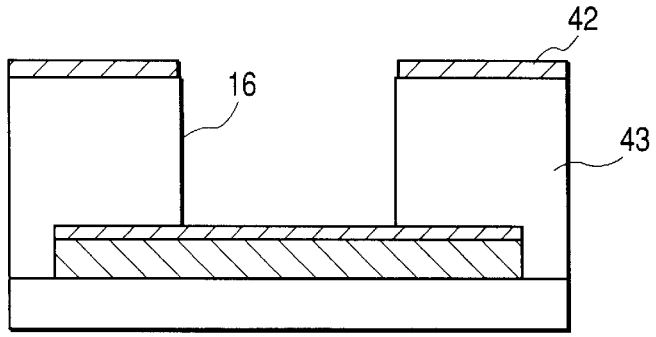
Figure 11D:
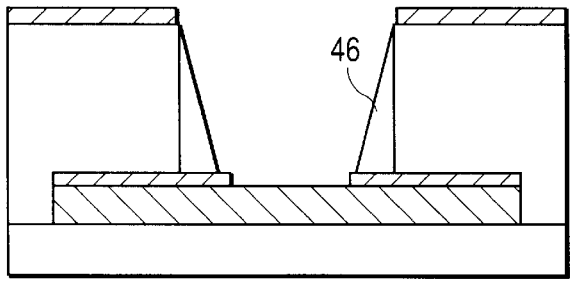
Figure 11E:
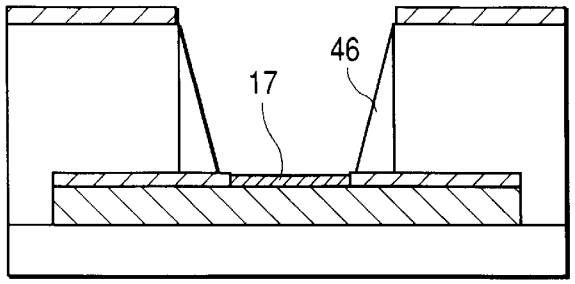

Next, as shown in FIG. 11C, $SiO_2$ of the 500 nm thickness was deposited as the insulating layer 43 and Ta of the 100 nm thickness was deposited as the first electrode layer 42 in this order. Subsequently, the layers were patterned in the same manner as the photolithography of step 2, and an opening was formed by dry-etching. At this point, since insulating separation was performed as well, the layers were subject to the photolithography and etching processes twice.

(Step 4)

Next, as shown in FIG. 1D, $SiO_2$ was deposited with a thickness of 200 nm as the second insulating layer 46 by the P-CVD method, and then was etched by the etchback method with gas of $Ar/CHF_3/CF_4$ series at 66.5 Pa and RF power of 800 W. Moreover, the Ti electrode being the third electrode layer 45 was etched to expose a foundation Ta layer at the center of the opening.

(Step 5)

Then, as shown in FIG. 1E, the electron-emitting layer 17 of diamond-like carbon including a low resistance diamond film was selectively deposited on the third electrode layer 45 in the order of 50 nm by the CVD method. Mixed gas of $CH_4$ and $H_2$ and oxygen were used as reactive gas.

The electron-emitting device manufactured as described above was arranged as shown in FIG. 3 and driven. A driving voltage was Vg=10 V, Va=5 kV, the second electrode layer 44 and the third electrode layer 45 had 0 V and the electron-emitting layer 17 also had 0 V. Further, the distance D3 between the electron-emitting layer 17 and the anode 12 was 1 mm.

Here, an electrode to which a phosphor was applied was used as the anode 12 to observe a size of an electron beam. The electron beam size referred to here was a size of an area where luminance is 10% or more of peak luminance of the phosphor emitting light. As a result, a beam diameter was 200 $\mu$m.

In addition, since low resistance wiring can be realized in the second electrode layer 44 and the third electrode layer 45 that are base electrodes, high-speed driving has become possible.

(Third Embodiment)

As a third embodiment, an example in which a dielectric constant of the second insulating layer 46 is made higher than a dielectric constant of the first insulating layer 43.

In this embodiment, the second insulating layer 46 is made of SiN. Since SiN has a dielectric constant 7 that is higher than a dielectric constant 3.9 of $SiO_2$ forming the first insulating layer 43, the equipotential surface on the surface of the electron-emitting film 17 was successfully formed in a recessed shape. Further, SiN by the plasma CVD was used for forming the second insulating layer 46 by a manufacturing method similar to that of the first embodiment.

The electron-emitting device manufactured as described above was arranged as shown in FIG. 3 and driven.

A driving voltage was Vg=10V, Va=5 kV and the distance D3 between the electron-emitting layer 17 and the anode 12 was 1 mm. Here, an electrode to which a phosphor was applied was used as the anode 12 to observe a size of an electron beam. The electron beam size referred to here was a size of an area where luminance is 10% or more of peak luminance of the phosphor emitting light. As a result, a beam diameter was 180 $\mu$m which was smaller than that in other embodiments.

(Fourth Embodiment)

An image-forming apparatus was manufactured with the electron-emitting devices of the first to third embodiments, respectively. As an example, an image-forming apparatus manufactured with the electron-emitting device of the first embodiment will be described.

The electron-emitting devices of the first embodiment were arranged in an MTX shape of 10×10. Wiring was connected to the first electrode layer 42 on the X side and to the second electrode layer 44 on the Y side. The devices were arranged with a horizontal pitch of 300 $\mu$m and a vertical pitch of 300 μm. A phosphor was disposed above the devices. As a result, a high-definition image-forming apparatus capable of matrix-driving was successfully manufactured.

As described above, the present invention can provide an electron-emitting device in which an electron beam diameter is small and an electron emission area is large, with which highly efficient electron emission is possible at a low voltage and whose manufacturing process is easy.

In addition, when such an electron-emitting device is applied to an electron source and an image-forming apparatus, an electron source and an image-forming apparatus that are excellent in performance can be realized.

As many apparently widely different embodiments of the present invention can be made without departing from the spirit and scope thereof, it is to be understood that the invention is not limited to the specific embodiments thereof except as defined in the appended claims.

What is claimed is:

1. An electron-emitting device comprising:

first and second electrode layers;

a first insulating layer sandwiched between said first electrode layer and said second electrode layer;

a first opening penetrating through said first electrode layer and said first insulating layer;

a third electrode layer, having a second opening, provided on said second electrode layer and diposed inside said frist opening, an electron-emitting material disposed inside said second opening and connected to said second electrode layer, and a second insulating layer having a third opening exposing said electron-emitting material, located inside said first opening and disposed on said third electrode layer, wherein said third opening is shaped in a taper such that an opening area adjacent said first electrode layer is larger than an opening area adjacent said second electrode layer.

2. An electron-emitting device according to claim 1, wherein said electron-emitting material is a conductor.

3. An electron-emitting device according to claim 1, wherein said second electrode layer, said third electrode layer and said electron-emitting material are supplied with a same potential.

4. An electron-emitting device according to claim 1, wherein an exposed surface of said electron-emitting material in said second opening is positioned on a surface on a same level as a boundary of said second insulating layer and said third electrode layer or adjacent said second electrode side.

5. An electron-emitting device according to claim 1, wherein an opening shape of said first opening is substantially circular.

6. An electron-emitting device according to claim 1, wherein an opening shape of said first opening is substantially rectangular.

7. An electron-emitting device according to claim 1, wherein said first insulating layer and said second insulating layer are made of different materials.

8. An electron-emitting device according to claim 1, wherein a dielectric constant of said second insulating layer is larger than a dielectric constant of said first insulating layer.

9. An electron-emitting device according to claim 1, wherein said third electrode layer and said electron-emitting material are formed of an identical material.

10. An electron source in which a plurality of electron-emitting devices are disposed, each electron-emitting device being an electron-emitting device according to any one of claims 1 to 9.

11. An electron source according to claim 10, wherein said plurality of electron-emitting devices are matrix-wired.

12. An image-forming apparatus comprising:

said electron source according to claim 10, and an image-forming material for forming an image by electrons emitted from said electron source colliding with the image-forming material.

13. An image-forming apparatus according to claim 12, wherein said image-forming material is a phosphor for emitting light by collision of electrons.

14. An electron-emitting device comprising:

first and second electrode layers;

an insulating layer disposed between said first electrode layer and said second electrode layer;

a first opening formed in said first electrode layer;

a second opening formed in said insulating layer and communicating with said first opening; and an electron-emitting film disposed in said second opening and connected to said second electrode layer, wherein said second opening is shaped in a taper such that an opening area adjacent said first electrode layer is larger than an opening area adjacent said second electrode layer, and wherein an outer circumference of said electron-emitting film is sandwiched between said insulating layer and said second electrode layer.

15. An electron source in which a plurality of electron-emitting devices are arranged, each electron-emitting device being an electron-emitting device according to claim 14.

16. An image-forming apparatus having said electron source according to claim 15 and a phosphor.

* * * * *

UNITED STATES PATENT AND TRADEMARK OFFICE

CERTIFICATE OF CORRECTION

PATENT NO. : 6,683,408 B2
DATED : January 27, 2004
INVENTOR(S) : Takeshi Ichikawa It is certified that error appears in the above-identified patent and that said Letters Patent is hereby corrected as shown below:

Column 4,
Line 19, “Electros” should read -- Electrons --; and
Line 65, “a insulating” should read -- an insulating --.

Column 11,
Line 28, “undorped” should read -- undoped --; and
Line 54, “the an” should read -- the --.

Column 12,
Line 43, “a pparatus” should read -- apparatus --.

Column 14,
Line 52, “act” should read -- to act --.

Column 15,
Line 46, “126 denote” should read -- 126 denotes --.

Column 16,
Line 53, “the a” should read -- the --.

Column 21,
Line 29, “frist” should read -- first --; and
Line 49, “side.” should read -- layer --.

Signed and Sealed this

Twenty-first Day of June, 2005

JON W. DUDAS
*Director of the United States Patent and Trademark Office*